United States Patent [19]

Benitez

[11] Patent Number: 5,022,517

[45] Date of Patent: Jun. 11, 1991

[54] BAR SOAP WRAP

[76] Inventor: Abel G. Benitez, 3431 Oakdale, #1610, San Antonio, Tex. 78229

[21] Appl. No.: 594,295

[22] Filed: Oct. 9, 1990

[51] Int. Cl.[5] ..... B65D 30/06; A47L 13/17

[52] U.S. Cl. ..... 206/77.1; 15/209 R; 401/201

[58] Field of Search ..... 15/209 B-209 E, 15/209 R, 244.3; 206/77.1; 401/201

[56] References Cited

U.S. PATENT DOCUMENTS

| | | | |
|---|---|---|---|
| 1,326,265 | 12/1919 | Hobbs | 15/244.3 |
| 1,993,174 | 3/1935 | Coney | 15/209 R |
| 2,574,854 | 11/1951 | West | 15/209 R |
| 3,048,938 | 8/1962 | Mears | 15/209 R |
| 3,114,928 | 12/1963 | Spiteri | 401/201 |
| 3,167,805 | 2/1965 | Zuppinger et al. | 401/201 |
| 4,228,834 | 10/1980 | Desnick | 401/201 |
| 4,457,640 | 7/1984 | Anderson | 401/201 |
| 4,457,643 | 7/1984 | Caniglia | 401/201 |
| 4,480,939 | 11/1984 | Upton | 401/201 |
| 4,969,225 | 11/1990 | Schubert | 15/209 C |

FOREIGN PATENT DOCUMENTS

| | | | |
|---|---|---|---|
| 0988818 | 4/1965 | United Kingdom | 401/201 |

*Primary Examiner*—Jimmy G. Foster

*Attorney, Agent, or Firm*—Gunn, Lee & Miller

[57] ABSTRACT

A wrap for bar soap having first and second side walls with side members extending along two side edges and a bottom edge of the side walls. The side members connect the two side walls together along the edges and maintain the spacing between them; they also provide venting. The side members have only two layers of material. The top edges of the side walls are not joined but are open for insertion and removal of the bar soap. The side walls have inner and outer layers. The inner layer is made from a multiplicity of overlapping layers of nylon netting. An intermediate layer of soft, foam cushion material is sandwiched between the outer and inner layers and connected to the layers only along the outer periphery of the intermediate layer. The outer layer may be of a thick terrycloth material or overlapping layers of nylon netting. The side members in the preferred embodiment are also made of the nylon netting material without the intermediate layer. With the terrycloth outer layer, venting eyelet openings are formed in the outer layer and cooperate with the overlapping layers of nylon netting in the inner layer to provide ventilation to the interior of the wrap. A fastener mechanism is provided along the top edge of the side walls to releasably close the top opening.

3 Claims, 2 Drawing Sheets

BAR SOAP WRAP

BACKGROUND OF THE INVENTION

The present invention relates to a wrapper for bar soap, and more particularly, a wrapper for retaining and protecting bar soap during washing operations.

One of the major reasons for reduced bar soap usage by consumers is the excessive waste associated with the product. Normally, bar soap is simply placed in an existing soap dish or soap tray after it is used. Water in the bottom of the dish or tray accumulates and the bar soap eventually rests in this accumulated water. The bar soap does not dry, but, instead, is softened by its contact with the water in the dish. The next time the soap is used, the softened outer portion of the bar soap quickly washes away, resulting in considerable product loss. With cost of soap per wash ranging from $0.005 to $0.300, the savings may be considerable.

Not only is there considerable waste, but the softening of the bar soap creates bathroom clean-up problems. Once the softened soap is deposited in the soap dish, it may eventually dry and harden. This results in excessive clean-up time.

Another problem with bar soap is its susceptibility to breaking or chipping upon impact after being dropped. It is not uncommon for the user to allow bar soap to slip from his or her grasp. When it strikes the wash bowl, tub, or shower floor, the bar generally cracks, breaks, or chips. These broken chips are usually washed down the drain or otherwise disposed of, again resulting in loss of product.

One method for solving the problem of bar soap softening in the tray has been to insert a rope into the core of the bar during manufacture. While this allows the soap to be suspended away from a tray thereby increasing its exposure to the air for drying, the increased costs of manufacture and materials are significant. Although the rope is intended to enable the user to suspend the soap around his/her neck, the user may still drop the soap resulting in breakage. Further, the rope must be disposed of when the bar is consumed and is not reusable. These factors create a negative environmental impact.

Some bar soap users have long fingernails which at times strike the bar and lodge solid pieces of soap beneath the nail. This lodged soap may not be noticed until later when it causes other problems.

The present invention addresses and eliminates each of the above enumerated problems.

SUMMARY OF THE INVENTION

The present invention provides a soft, colorful, and, if desired, a slightly abrasive outer wrap for a bar of soap.

The present invention not only eliminates waste and reduces clean-up time, it also provides the consumer with a means of color coordinating any brand of soap with decor of any given room. The wrap of the present invention may be provided with exterior decoration or coloring to match any bathroom fixture or towel and bath set.

Further, the present invention provides the user with a cleaning product that has a soft, and slightly abrasive outer surface, if desired, to stimulate the skin when it is being used. The user does not have to actually contact the bar of soap with his or her hands and that eliminates the situation where solid soap may become lodged beneath the finger nails or toe nails.

A pouch-like bar soap wrap with a top opening and closure mechanism is constructed with two multilayer side walls and side members with vents. The side walls have outer and inner layers. The inner layer is formed from multilayer nylon lattice material. A layer of soft foam cushioning material forms the intermediate layer. The outer layer may be constructed of thick, terrycloth or multi-layer nylon lattice material. The side members with vents of the present invention are constructed of nylon netting material on the inside and outside layers without the intermediate layer. With the terrycloth outer layer, a multiplicity of vent eyelet holes are formed in the outer layer and extend to the inner nylon netting material. The vents facilitate the full ventilation or circulation of air within the interior of the wrap to quickly dry the bar soap retained therein.

BRIEF DESCRIPTION OF THE DRAWINGS

In describing the invention in detail, reference is had to the accompanying drawings, forming a part of this specification, and wherein like numerals of reference indicate corresponding parts throughout the several views in which.

DETAILED DESCRIPTION OF THE PREFERRED EMBODIMENT

Figure 1:
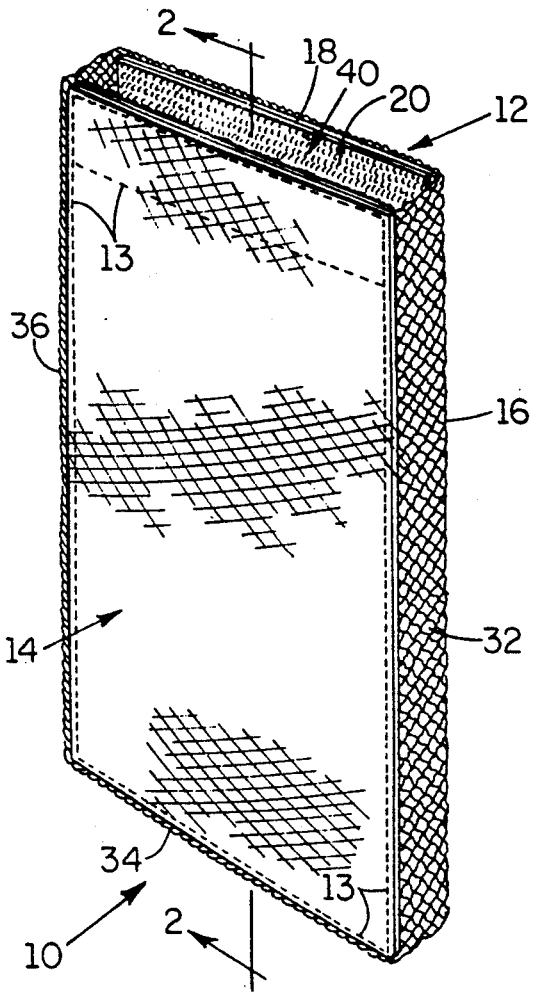
FIG. 1 illustrates a perspective view of the present invention with the top open and no bar soap inside.

FIG. 1 illustrates the present wrap invention 10 without a bar of soap in it. The pouch-like container is formed by two side walls 12 and 14 joined along three edges by nylon netting material 16 with a lattice network. The top edge 18 is provided with an opening 40 and a closing mechanism 20 which allows the user to insert and remove the bar soap. In FIG. 1 the top is open.

Figure 2:
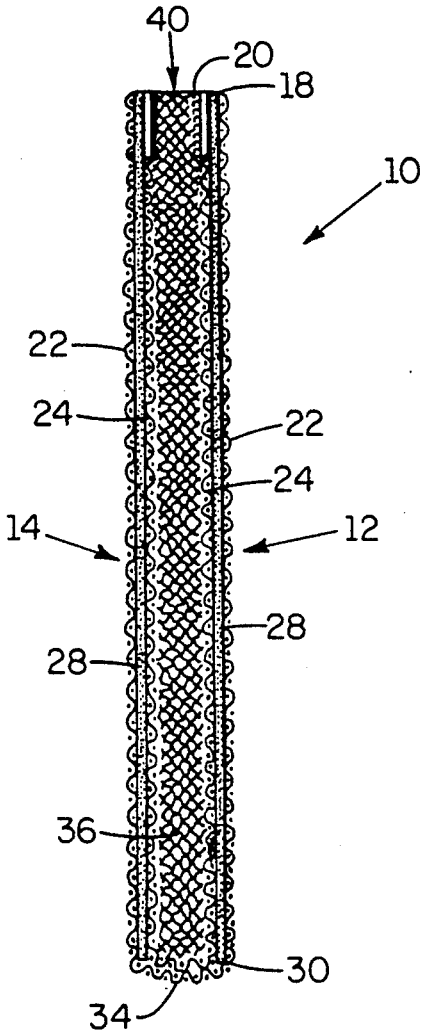
FIG. 2 illustrates a cross sectional view of the present invention taken along lines 2—2 of FIG. 1.

The side wall construction is illustrated in the cross sectional view of FIG. 2. Walls 12 and 14 have outer layers constructed of nylon netting material. The outer layer is not attached to the intermediate layer except along the seams 13 and thus lies loosely upon the intermediate layer as will be seen hereinafter. It is well known that this type of netting material is constructed of a multiplicity of layers of nylon fibers which have been arranged in a lattice-like configuration. When one layer is placed upon another, the fibers overlap and open spaces between the fibers form numerous, small air pockets. Thus, the netting material used in the present invention results in an outer surface on walls 12 and 14 which is extremely porous and slightly abrasive.

Figure 3:
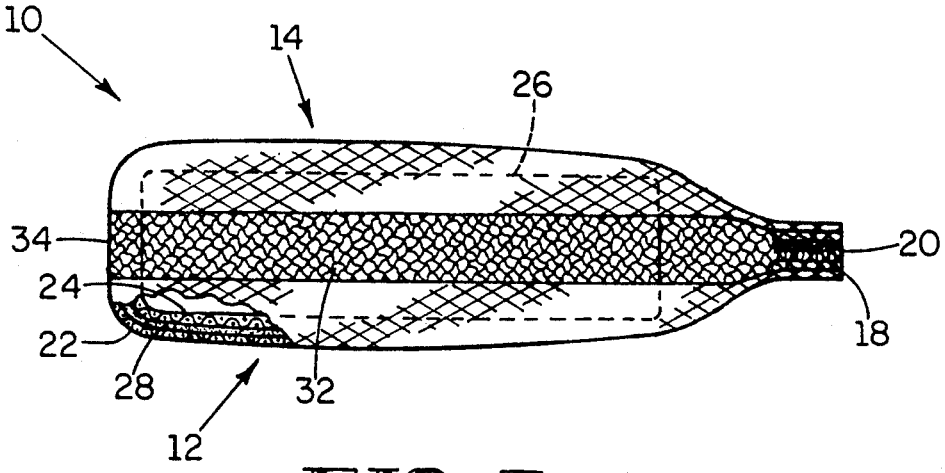
FIG. 3 illustrates a side view of the present invention partially cut away with the top closed and a bar of soap inside shown in hidden lines.

Inner wall layer 24 is similarly constructed of the nylon netting material and is only attached to the intermediate layer as discussed above. Since inner wall layer 24 is formed of a multiplicity of nylon network layers, a surface is formed which results in the bar soap 26 only contacting the surface along the outer edges of the individual nylon fibers (FIG. 3). Thus, the majority of the soap's surface area is not in contact with the inner layer 24 of walls 12 or 14. As will be discussed below this minimum contact of the soap bar 26 with the inner wall 24 yields an improved means for ventilation or air circulation within the interior of the wrap 10 for drying the bar of soap 26.

Between inner layer 24 and outer layer 22 of walls 12 and 14 is an intermediate layer 28 of soft plastic foam material. Layer 28 provides support for walls 12 and 14 while being light in weight and extremely porous. The cushioning effect of layer 28 not only makes the wrap 10 soft to the touch, but protects the bar from breakage or chipping if dropped. As may be seen in FIG. 2, layer 28 extends from the top edge 18 to the bottom edge 30 of wrap 10.

It has been found that foam layer 28 will retain a small volume of water when in use in a washing operation. This improves lathering when wrap is used. However, because the foam layer does not absorb moisture into the plastic composition itself, simply squeezing or pressing on the foam layer will drive excess water from the material. Natural fibers such as cotton absorb the moisture into the fiber itself and thus tend to hold water.

Because layer 28 is composed of an extremely porous material, air easily circulates through walls 12 and 14. The combination with the nylon lattice network of inner layer 24 and outer layer 22 and the porous foam layer 28 results in a wrap which essentially suspends bar 26 in such a way as to provide through ventilation or air circulation around the bar in the interior of the wrap.

Along the three edges where side walls 12 and 14 are joined, side members 32, 34, and 36 are formed. The side members consist only of nylon netting material in an inner layer and an outer layer without the foam intermediate layer. A means for ventilating the interior of the wrap is thus formed by the overlapping nylon fibers with numerous air pockets or vents between them. Side members 32, 34, and 36 thus allow for air to more easily circulate through wrap 10.

Once a bar of soap 26 is inserted through opening 40 in the top 18 of wrap 10, closure mechanism 20 is pressed together, and the bar 26 is retained inside the wrap 10. Closure mechanism 20 in the preferred embodiment is the conventional fabric hook and loop fastener. Other fasteners may be used.

FIG. 3 illustrates the wrap 10 of the present invention in a closed condition with bar 26 shown in hidden lines. Side member 32 is shown extending along an edge joining side walls 12 and 14.

The partial cut-away illustrated in FIG. 3 shows how the soap 26 only contacts a small surface area of the inner netting. As previously discussed, numerous air pockets or spaces are founded allowing air to circulate around the soap.

While it is not shown in the drawings it may be understood that exterior designs may be imprinted on the outer surface 22 of walls 12 and 14 to coordinate with any given bathroom design. Since the wrap 10 is intended to be refilled after the bar of soap is consumed, it will be understood that any brand or color of bar soap may be inserted into wrap 10. Further, the color variations of the netting material are considerable and provide a ready match with most bathroom decors.

Figure 4:
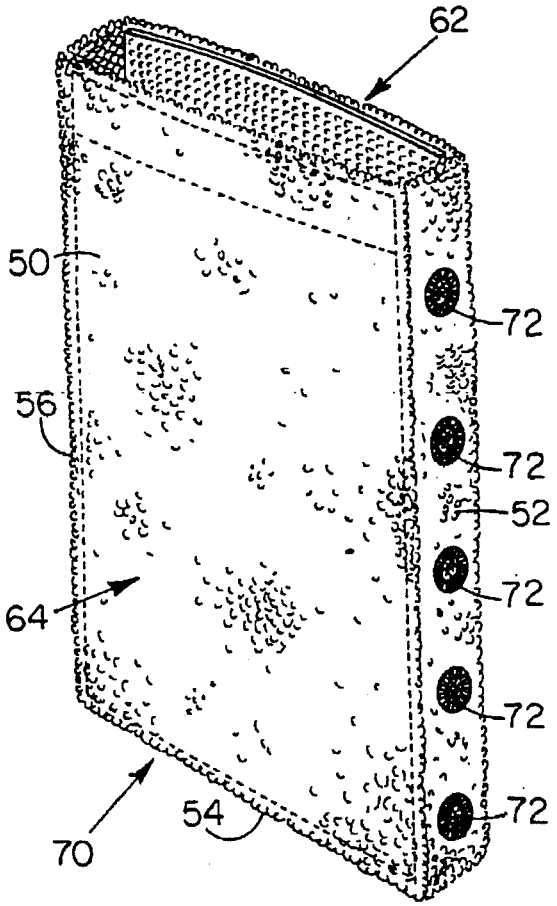
FIG. 4 illustrates a perspective view of an alternative embodiment of the present invention with the top open and no bar soap inside.

FIG. 4 illustrates an alternative embodiment of the present invention in which the outer layer 50 is a thick, terrycloth material commonly used with bath towels and cloths. The intermediate layer on the side walls 62 and 64 in the embodiment of FIG. 4 is the same foam construction as that discussed above in the embodiment of FIGS. 1–3. Because the inner layer 60 (FIG. 5) is still of multilayer layers of nylon netting the soap inside the wrap 70 is not exposed to or in contact with the terrycloth. Thus, soap placed inside the wrap of this alternative embodiment is still suspended on the edges of the non-porous nylon fibers. The use of the terrycloth outer layer 50 enables the wrap to be designed to match almost any bath fixture or bath towel combination.

Figure 5:
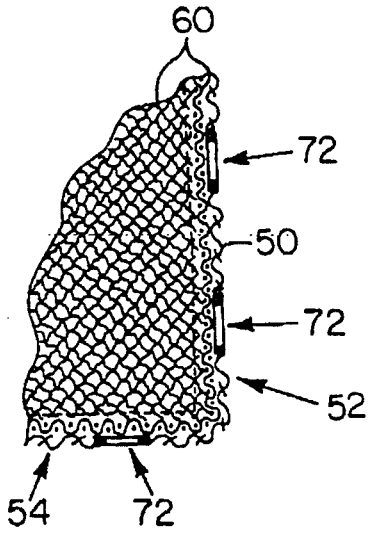
FIG. 5 illustrates a partial cross sectional view of the embodiment of FIG. 4 showing the vent eyelets.

Side members 52, 54, and 56 join side walls 62 and 64 just as side members 32, 34, and 36 joined walls 12 and 14 in the preferred embodiment. However, to facilitate ventilation of the interior of the wrap 70 side members 52, 54, and 56 are provided with venting eyelet orifices 72. FIG. 5 illustrates in a partial cross sectional view of wrap 70 with the two layer construction on the side members 52 and 54 of the alternative embodiment. The side members are made up of outer layer 50 and inner layer 60 without an intermediate layer. Inner layer 60 is similar to that discussed above with the preferred embodiment wrap 10. It is a layer made up of a multiplicity of overlapping layers of nylon fibers or netting in a lattice network. Outer layer 50 is common terrycloth. Eyelet orifices 72 are sewn into openings in the terrycloth to provide a ready means for air to enter and/or moisture to escape from the interior of the wrap. Because eyelets 72 are provided in all side members 52, 54, and 56, adequate ventilation is achieved. Eyelets 72 cooperate with the air space or air pockets formed in the inner layer 60 to provide the ventilation or air circulation.

Although FIG. 4 illustrates eyelets 72 in a single line around the side members 52, 54, and 56, it is to be understood that other arrangements of the eyelets in the side members are within the scope of the present invention. For example, two eyelets may be placed side-by-side to improve ventilation.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A wrap for bar soap comprising:

a first and a second side wall each of said side walls further comprising an outer layer, an intermediate layer, and an inner layer, said inner layer further comprising a multiplicity of overlapping layers of nylon netting having a lattice network, said intermediate layer being of soft, foam cushion composition and attached to said outer and said inner layers along the outer periphery of said intermediate layer;

said side walls spaced apart and connected along two side edges and a bottom edge by a side member having an inner layer and outer layer, said inner layer comprising a multiplicity of overlapping layers of nylon netting having a lattice network, said side member having a means for ventilating the interior of said wrap;

said side walls spaced apart along a top edge to form an opening for insertion and removal of said bar soap, said opening further comprising a means for releasably closing said opening.

2. The wrap of claim 1 wherein said outer layer of said side member further comprises a multiplicity of overlapping layers of nylon netting having a lattice network.

3. The wrap of claim 1 wherein said means for ventilating said interior of said wrap further comprises a plurality of eyelet openings in said outer layer of said side member, said eyelets cooperating with said overlapping layers of nylon netting of said inner layer to provide ventilation to said interior of said wrap.

* * * * *